US006517471B2

(12) United States Patent
Chen

(10) Patent No.: US 6,517,471 B2
(45) Date of Patent: Feb. 11, 2003

(54) EXERCISE BALL WITH AN AIR LAYER

(76) Inventor: Szu-Jen Chen, 219-248 Moo 12, Petdhkasem Rd., Oom-Noi Krathumban Samutsakron 74130 (TH)

( * ) Notice: Subject to any disclaimer, the term of this patent is extended or adjusted under 35 U.S.C. 154(b) by 80 days.

(21) Appl. No.: 09/876,965

(22) Filed: Jun. 11, 2001

(65) Prior Publication Data

US 2002/0187887 A1 Dec. 12, 2002

(51) Int. Cl.[7] ..... A63B 71/00
(52) U.S. Cl. ..... 482/148; 473/604; 446/220
(58) Field of Search ..... 482/148; 473/569, 473/604, 605–609; 446/220

(56) References Cited

U.S. PATENT DOCUMENTS 4,333,648 A * 6/1982 Aoyama ..... 273/65 EB
4,606,544 A * 8/1986 Olazabal ..... 273/65 R
5,306,001 A * 4/1994 Shishido et al. ..... 273/65
6,022,283 A * 2/2000 Schindler et al. ..... 473/605
6,099,423 A * 8/2000 Ou ..... 473/604

FOREIGN PATENT DOCUMENTS

EP 0941749 A1 * 9/1999

* cited by examiner

*Primary Examiner*—Jerome W. Donnelly
*Assistant Examiner*—Lori Baker Amerson
(74) *Attorney, Agent, or Firm*—Fei-Fei Chao; Venable, Baetjer, Howard & Civiletti, LLP

(57) ABSTRACT

An exercise ball has a bladder, a yarn lining wound on an outer face of the bladder, an air layer formed between the outer face of the bladder and the yarn lining, a cloth lining wrapped on the yarn lining, an adhesive layer applied on an outer surface of the cloth lining, a sponge lining securely attached to the cloth lining by the adhesive layer, and an outer surface securely engaged with the sponge lining. With the provision of the air lining and the sponge lining, the exercise ball is able to maintain its softness.

1 Claim, 2 Drawing Sheets

EXERCISE BALL WITH AN AIR LAYER

BACKGROUND OF THE INVENTION

1. Field of the Invention

The present invention relates to an exercise ball, and more particularly to an exercise ball with an air layer provided between the inner bladder and a yam lining, a swaddled lining around the yam lining to strengthen the rigidity of the bladder and a sponge lining to maintain the soft feel of the surface of the ball.

2. Description of Related Art

A basketball, a volleyball, a handball or any large ball used for sports activities usually has an inner bladder and an outer rubber or leather surface mounted outside the bladder. Consequently, the hardness or softness of the ball is determined by the air pressure inside the inner bladder. When the air pressure in the bladder is too high, the user is easily hurt by the impact of the ball. When the pressure in the bladder is too low, the ball responds sluggishly to being bounced, hit or dribbled and slows down the sporting activity. Therefore, it is quite difficult for the user to determine when the pressure inside the bladder is correct especially when there is no pressure gauge at hand to measure the pressure inside the bladder.

To overcome the shortcomings, the present invention tends to provide an improved exercise ball to mitigate and obviate the aforementioned problems.

SUMMARY OF THE INVENTION

The primary objective of the present invention is to provide an exercise ball having an air layer and a sponge lining inside the ball so that the ball is able to be soft even if the pressure inside the bladder is higher than what is needed.

Another objective of the present invention is to provide a yarn lining mounted on an outer periphery of the bladder and a swaddled lining around the yarn lining, such that the rigidity of the ball is ensured.

Other objects, advantages and novel features of the invention will become more apparent from the following detailed description when taken in conjunction with the accompanying drawings.

DETAILED DESCRIPTION OF THE PREFERRED EMBODIMENT

Figure 1:
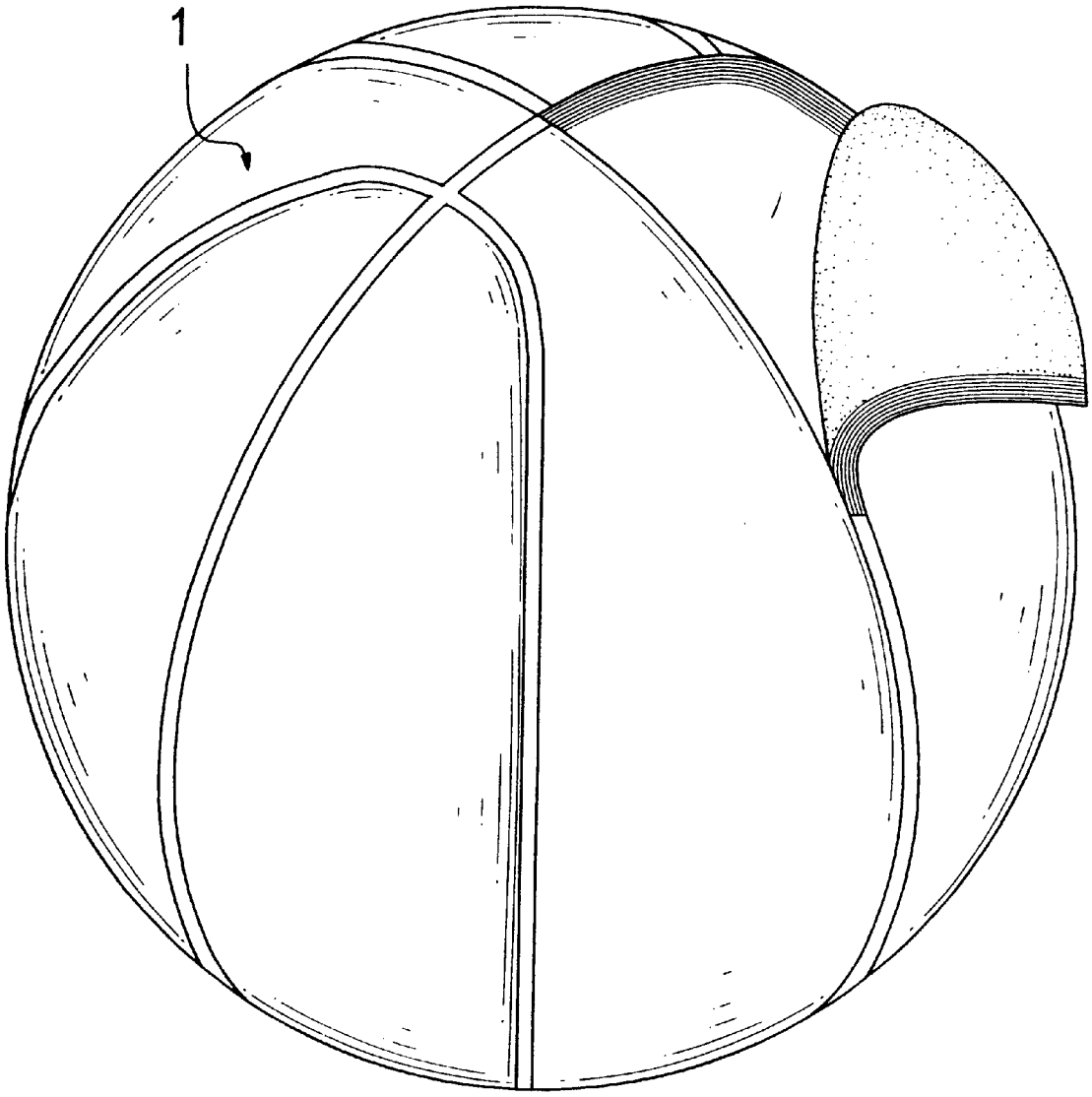
FIG. 1 is a perspective view of the exercise ball in partial section showing the interior structure of the ball.
Figure 2:
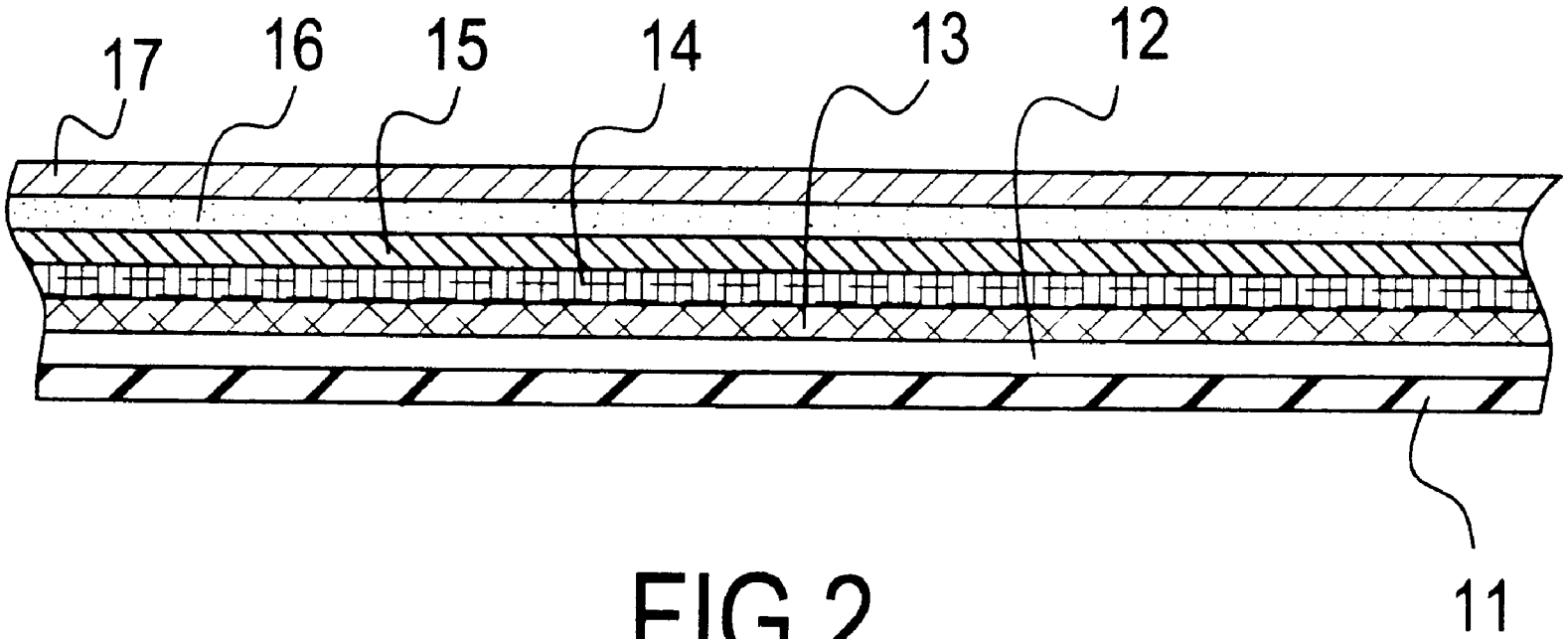
FIG. 2 is a cross sectional view of the exercise ball in FIG. 1 showing different layers inside the ball.

With reference to FIGS. 1 and 2, a preferred embodiment of the exercise ball (1) in accordance with the present invention comprises a bladder (11), an air layer (12), a yarn lining (13), a cloth layer (14), an adhesive layer (16) and a surface layer (17).

To make the exercise ball (1), first a layer of methylbenzene solution is applied to the outer face of the bladder (11). Then a layer of yarn (13) is loosely wound on the bladder (11). After the yarn layer (13) is applied on the outer face of the bladder (11) to sandwich the methylbenzene solution, a cloth layer (14) is wound on the yarn layer (13) to strengthen the rigidity of the bladder (11). Thereafter, a sponge layer (15) is bonded to the cloth layer (14). After an outer surface (17) is attached to the sponge layer (15), the entire ball is vulcanized. During the vulcanization process, the methylbenzene solution sandwiched between the yam lining (13) and the bladder (11) is vaporized and thus forms an air layer (12) and the outer surface (17) made of leather or other suitable material is securely attached to the sponge layer (15).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exercise ball comprising:

a bladder;

a yarn lining wound on an outer face of the bladder;

an air layer formed between the outer face of the bladder and the yarn lining;

a cloth lining wrapped on the yarn lining;

an adhesive layer applied on an outer surface of the cloth lining;

a sponge lining securely attached to the cloth lining by the adhesive layer; and an outer surface securely engaged with the sponge lining.

* * * * *